United States Patent [19]

Baird

[11] Patent Number: 4,907,303

[45] Date of Patent: Mar. 13, 1990

[54] ORTHOPEDIC CHAIR

[76] Inventor: Lincoln F. Baird, 3482 Moore St., Los Angeles, Calif. 90066

[21] Appl. No.: 52,602

[22] Filed: May 19, 1987

Related U.S. Application Data

[63] Continuation-in-part of Ser. No. 781,134, Sep. 26, 1985.

[51] Int. Cl.[4] ..... A47C 1/02; A47K 11/06; A61G 7/02

[52] U.S. Cl. ..... 4/480; 4/251; 297/DIG. 10; 297/339; 297/313; 292/171

[58] Field of Search ..... 4/480, 251, 254; 297/DIG. 10, 339, 337, DIG. 4, 283, 313, 332, 335, 336; 292/171

[56] References Cited

U.S. PATENT DOCUMENTS

| | | | |
|---|---|---|---|
| 2,572,730 | 10/1951 | Jones | 292/171 |
| 2,644,957 | 7/1953 | Shudde | 4/480 |
| 3,261,031 | 7/1966 | Gates | 4/480 |
| 3,539,220 | 11/1970 | Aquilar | 297/DIG. 10 |
| 4,461,160 | 7/1984 | Van Gompel | 292/171 |
| 4,474,393 | 10/1984 | Kimura | 292/171 |
| 4,538,853 | 9/1985 | Levenberg | 297/DIG. 10 |

FOREIGN PATENT DOCUMENTS

| | | | |
|---|---|---|---|
| 49034 | 1/1978 | Australia | 297/DIG. 10 |

*Primary Examiner*—Henry J. Recla
*Attorney, Agent, or Firm*—W. Edward Johansen

[57] ABSTRACT

The present invention is an orthopedic chair which may be used to assist an invalid to easily sit therein or to rise therefrom. The orthopedic chair includes a frame and a seat which is pivotally coupled to the frame at the front thereof, a back which is mechanically coupled to the frame, a right arm-rest and a left arm-rest both of which are mechanically coupled to the frame. The orthopedic chair also includes a spring tensioning mechanism which resiliently biases the seat, when it is in its first position, toward its second position and a releasing mechanism which releases the seat so that the spring tensioning mechanism moves the seat from its first position to its second position.

8 Claims, 6 Drawing Sheets

Fig. 1.
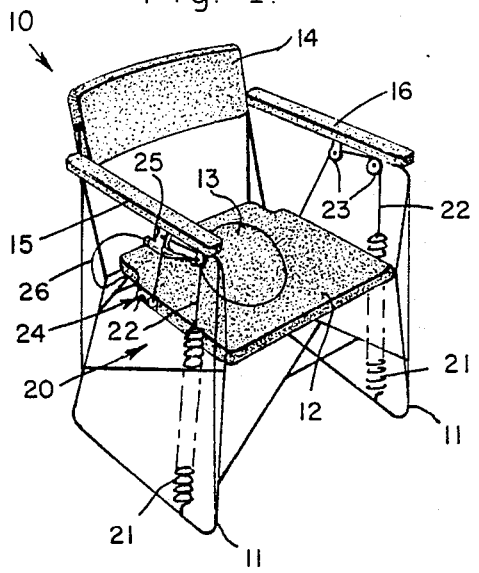
Fig. 2.
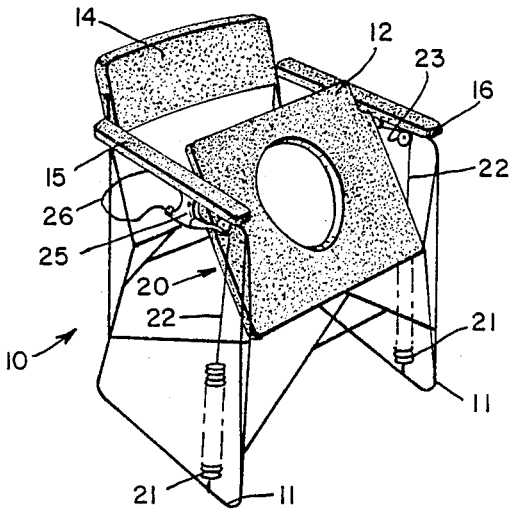
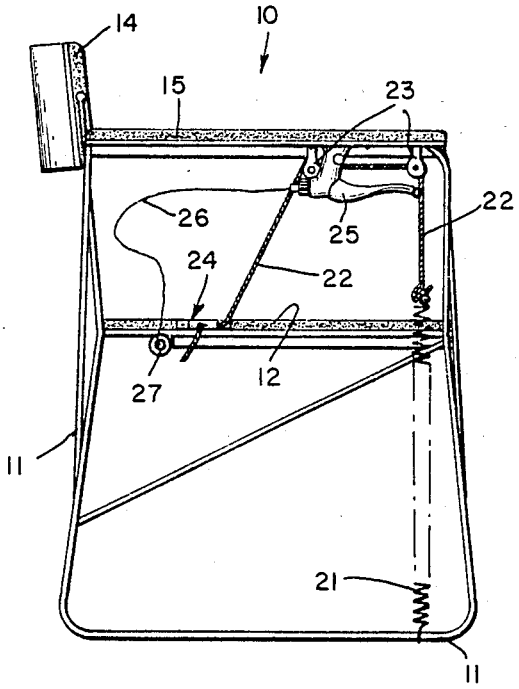
Fig. 3.
Fig. 4.
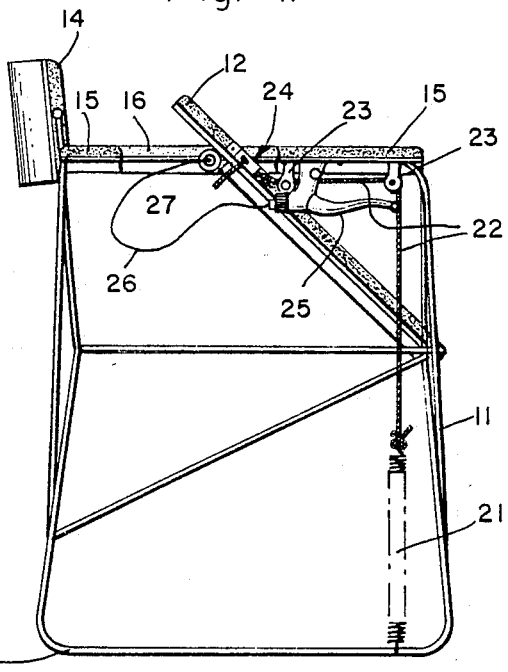

Fig. 5.
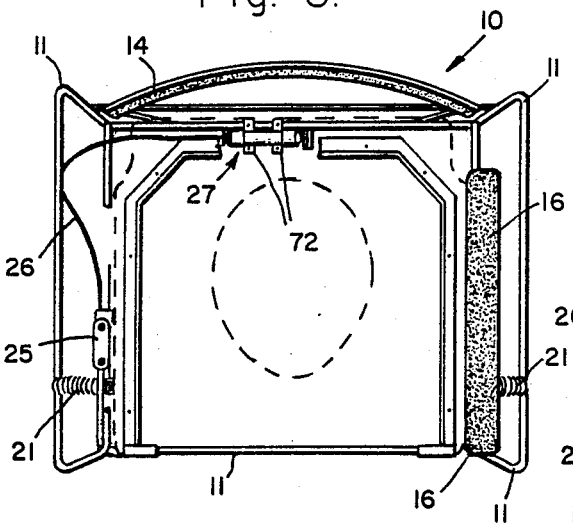
Fig. 6.
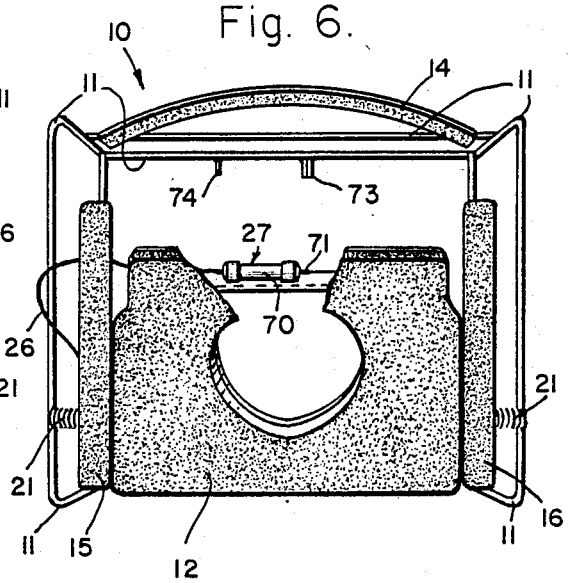
Fig. 7.
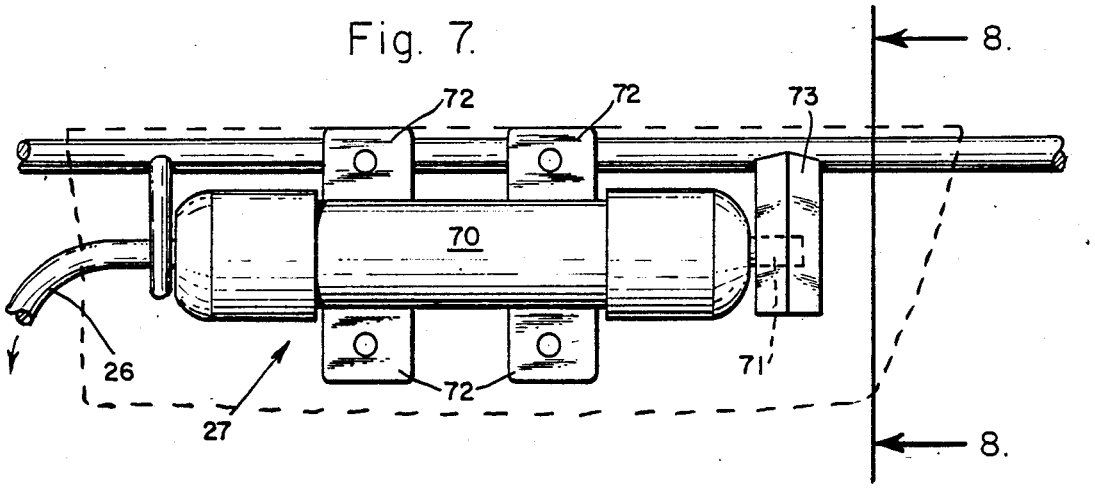
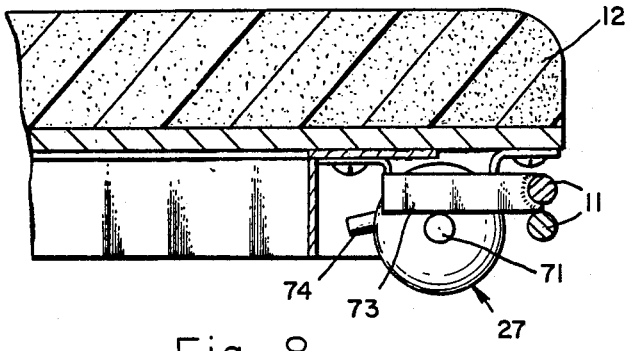
Fig. 8.

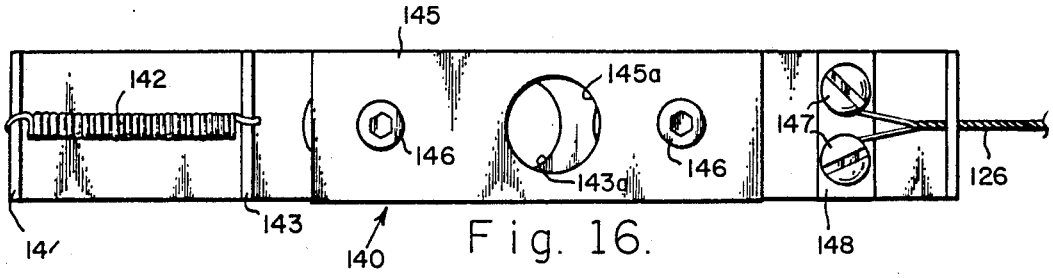
Fig. 16.
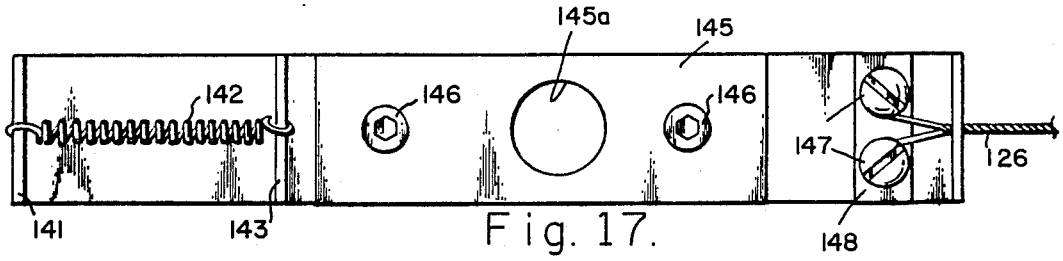
Fig. 17.
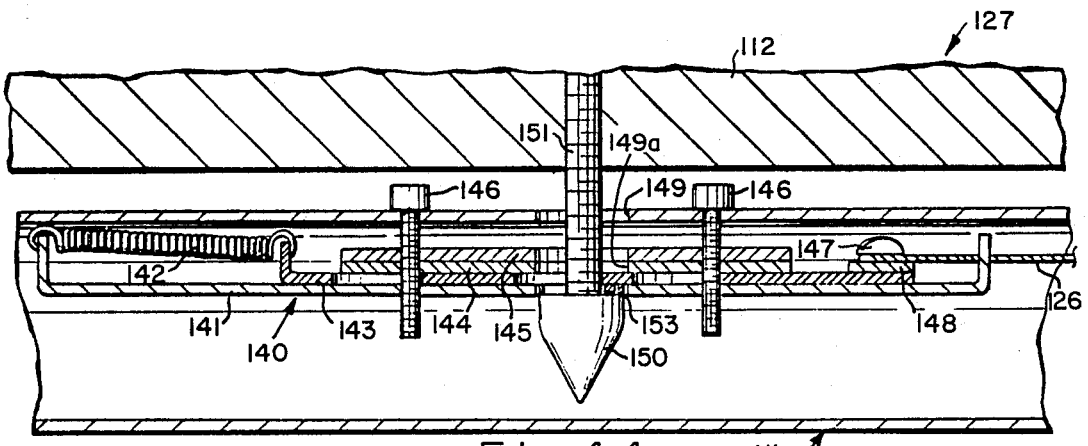
Fig. 14.
Fig. 13.
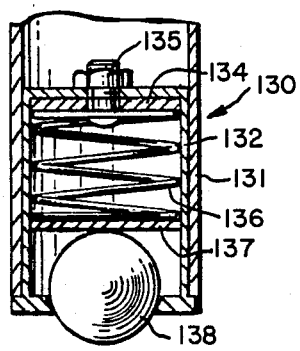
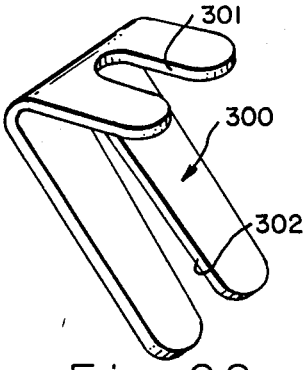
Fig. 22.
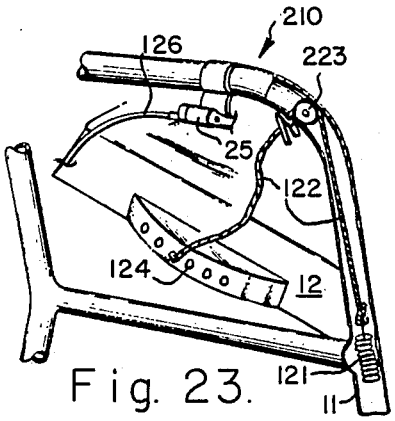
Fig. 23.

ORTHOPEDIC CHAIR

This application is a continuation-in-part of the application, having Ser. No. 781,134, filed Sept. 26, 1985.

BACKGROUND OF THE INVENTION

1. Field of the Invention

The present invention relates to orthopedic chairs and more particularly to an orthopedic chair which assists an invalid to easily sit therein or to rise therefrom.

2. Description of the Prior Art

U.S. Pat. No. 4,538,853, entitled Chairs for Handicapped Persons, issued to Nat Levenberg on Sept. 3, 1985, teaches a chair with resilient mechanism for assisting an occupant in raising himself to a standing position. The seat cushion pivots relative to the chair frame about an axis near the rearward edge thereof. This movement also serves to at least simultaneously partially elevate the arm rest. When the chair is occupied, the resilient struts are compressed so that seat may be manually locked in position against strut compression.

U.S. Pat. No. 3,975,051 entitled Orthopedic Chair issued to Robert V. Ballagh on Aug. 17, 1976 teaches an orthopedic chair particularly adapted for the use of an invalid or patient suffering from disabling diseases such as arthritis, sciatica, or the like. The orthopedic chair includes a movably supported frame assembly that serves to maintain a forwardly and downwardly extending saddle-shaped seat at a desired elevation between a pair of laterally spaced side walls and a back rest. The frame movably supports first and second reversible electric motors that drive first and second mechanisms that pivot the first and second leg supports to desired angular positions relative to the first and second channels. First and second electric switch mechanisms are mounted at convenient locations on the first and second side walls to permit the user of the invention to selectively energize either the first and second members either jointly or individually to pivot the first and second leg supports to desired angular positions. Due to the configuration of the saddle-shaped seat, the user in the orthopedic chair is at all times urged into a position where his feet are maintained in contact with foot rests that form a part of the leg supports. The orthopedic chair preferably has a source of electricity, such as a battery, which is removably mounted thereon in a concealed position U.S. Pat. No. 4,358,156 entitled Floor Rest And Actuator For Chairs For Patients And Invalids issued to Harold M. Sharff on Nov. 9, 1982 teaches a chair which includes a relatively elevated seat with an adjustably pivotal foot rest. The foot rest can be positioned in both useful and out-of-the-way positions. The chair also includes an easily operable manual lever which occupant uses to move the foot rest in order to provide a comfortable foot support for invalids, particularly arthritics. There are many invalid chairs which have power assist for helping an infirm or arthritic person rise from the chair. The chair uses no power operated parts. The seat of the chair is elevated and the foot rest is adjustable so that it can be swung by the occupant to either a useful position or an out-of-the-way position, so that the patient or arthritic person may be seated with the least difficulty and may more easily get out of the chair with the least aid and with the least difficulty.

The chair is provided with a padded seat in a fixed position with relation to its supporting floor. This seat is elevated with respect to a normal chair so that the arthritic person or invalid may simply lean back on it and be seated with the least trouble. That is, the forward edge of the chair seat strikes an adult well above the knees. The adjustably pivoted foot rest is provided, when placed in its out-of-the-way position, does not interfere with the person standing in front of the chair preparatory to being seated therein or to rising from the chair. The foot rest can be adjustably pivoted out and is vertically adjustable for the purpose of best supporting the feet of the occupant of the chair. The foot rest is solidly supported at four corners. This is a safety feature in that the chair will not pivot over frontwards if the patient stands on the foot rest.

However, in order to assist the patient in getting in and out of the chair, the manually operable lever and linkage allow the patient to, selectively at either side of the chair, pivot the foot rest himself down to a useful substantially horizontal position, or to pivot it back within the confines of the chair where it is out-of-the-way and does not interfere with the patient getting into or out of the chair.

SUMMARY OF THE INVENTION

In view of the foregoing factors and conditions which are characteristic of the prior art it is the primary object of the present invention to provide orthopedic chair which assists an invalid to easily sit therein or to rise therefrom.

It is another object of the present invention to provide an orthopedic chair which does not require a powerdriven motor to assist an invalid to get up therefrom.

In accordance with the present invention an embodiment of an orthopedic chair which assists an invalid to easily sit therein or to rise therefrom is described. The orthopedic chair includes a frame, a seat which is pivotally coupled to the frame at the front thereof, a back which is mechanically coupled to the frame, a right arm-rest and a left arm-rest both of which are mechanically coupled to the frame. The orthopedic chair also includes a spring tensioning mechanism which resiliently biases the seat, when it is in its first position, toward its second position and a releasing mechanism which releases the seat so that the spring tensioning mechanism moves the seat from its first position to its second position.

The features of the present invention which are believed to be novel are set forth with particularity in the appended claims.

Other claims and many of the attendant advantages will be more readily appreciated as the same becomes better understood by reference to the following detailed description and considered in connection with the accompanying drawing in which like reference symbols designate like parts throughout the figures.

DESCRIPTION OF THE DRAWING

FIG. 1 is a perspective view of a first embodiment of a first orthopedic chair which has been constructed in accordance with the principles of the present invention and which is in a first position.

FIG. 2 is a perspective view of the first orthopedic chair of FIG. 1 which is in a second position.

FIG. 3 is a right side elevation of the first orthopedic chair of FIG. 1.

FIG. 4 is a right side elevation view of the first orthopedic chair of FIG. 2.

FIG. 5 is a top plan view of the first orthopedic chair of FIG. 1.

FIG. 6 is a top plan view of the first orthopedic chair of FIG. 2.

FIG. 7 is a partial, rear elevation of the first orthopedic chair of FIG. 1.

FIG. 8 is a partial, right side elevation in cross-section of the first orthopedic chair of FIG. 1 taken along the line 8—8 of FIG. 7.

FIG. 13 is a front elevation in cross-section of a caster which has been constructed in accordance with the principles of the present invention and which is fixedly coupled to each of the legs of the second orthopedic chair of FIG. 9.

FIG. 14 is a rear elevation in cross-section of a frame and a latch mechanism of the second orthopedic chair of FIG. 9 with the frame and the latch mechanism being fixedly, but detachably coupled together by a plug.

FIG. 16 is a top plan view of the latch mechanism of FIG. 14 with the sliding member being in a first position so that the sliding member the plug.

FIG. 17 is a top plan view of the latch mechanism 24 of FIG. 14 with the sliding member being in a second position 25 so that the sliding member disengages the plug.

FIG. 22 is a perspective view of an adjustment tool which may be used with all embodiments of the orthopedic chair.

FIG. 23 is a partial perspective view of the adjustment tool of FIG. 22 in operation on the tensioning system of the third orthopedic chair of FIG. 21 which is in the second position.

DESCRIPTION OF THE PREFERRED EMBODIMENT

Figure 10:
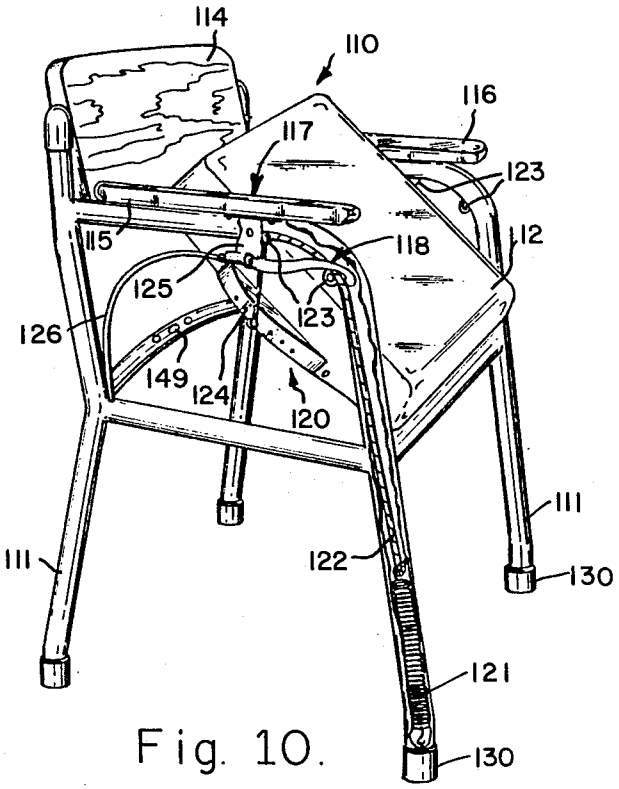
FIG. 10 is perspective view of the second orthopedic chair of FIG. 9 which is in a second position.

In order to best understand the present invention it is necessary to refer to the following description of its preferred embodiment in conjunction with the accompanying drawing. Referring to FIG. 1 in conjunction with FIG. 2 a first orthopedic chair 10 includes a frame 11 and a seat 12 which is pivotally coupled to the frame 11 at the front thereof. The frame 11 may be constructed out of stainless steel, wood, or plastic so long as the material used is strong enough to withstand the force generated, but light in weight. The seat 12 has a center hole so that an invalid may use the first orthopedic chair in conjunction with a toilet. A cover-late 13 covers the center hole of the seat 12 so that the invalid may use the first orthopedic chair 10 for other activities. The first orthopedic chair 10 also includes a back 14, a right arm-rest 15 and a left arm-rest 16 all of which are mechanically coupled to the frame 11. The first orthopedic chair 10 further includes a seat mechanism 20 for resiliently pivoting the seat 12 so that the seat 12 of the first orthopedic chair 10 may be used to assist an invalid to easily sit therein or to rise therefrom.

Referring to FIG. 3 in conjunction with FIG. 4 the seat mechanism 20 includes a spring tensioning mechanism and a releasing mechanism. The spring tensioning mechanism includes a pair of springs 21, a pair of cable 22 and two sets of pulleys 23. Each of the springs 21 has a first end which is mechanically coupled to the base of the frame 11 and a second end which is mechanically coupled to a first end of one of the cables 22. Each cable 22 is threaded through one of the sets of pulleys 23 so that the second end of each cable 22 is securably coupled to the seat 12 by a first adjusting device 24. The spring tensioning mechanism resiliently biases the seat 12, when it is in its first position, toward its second position. The first adjusting device 24 is securably coupled to the seat 12. The first adjusting device 24 allows adjusting the length of the cable 22 in order to adjust the spring tension in each spring 21.

Referring to FIG. 3 in conjunction with FIG. 4, FIG. 5 and FIG. 6 the releasing mechanism includes a release lever 25 and a release cable 26 which is mechanically coupled to the release lever 25. The release lever 25 and the cable 326 may be modified from a bicycle handbrake lever and its cable. The releasing mechanism also includes a spring loaded latch 27 which is mechanically coupled to the cable 26 and which releases the seat 12 so that the spring tension mechanism moves the seat 12 from its first position to its second position.

Referring to FIG. 5 in conjunction with FIG. 6, FIG. 7 and FIG. 8 the spring loaded latch 27 includes a tubular casing 70, a pin 71 which is resiliently coupled within the tubular casing 70. The spring loaded latch 27 also includes a pair of mounting member 72 for securably coupling the tubular casing 70 to the seat 12. The frame has a pin-stop 73 which is mechanically coupled to the frame 11 and which engages the pin 71 and a casing-stop 74 which is mechanically coupled to the frame 11 and which secures the tubular casing in place when it is under tension.

Figure 9:
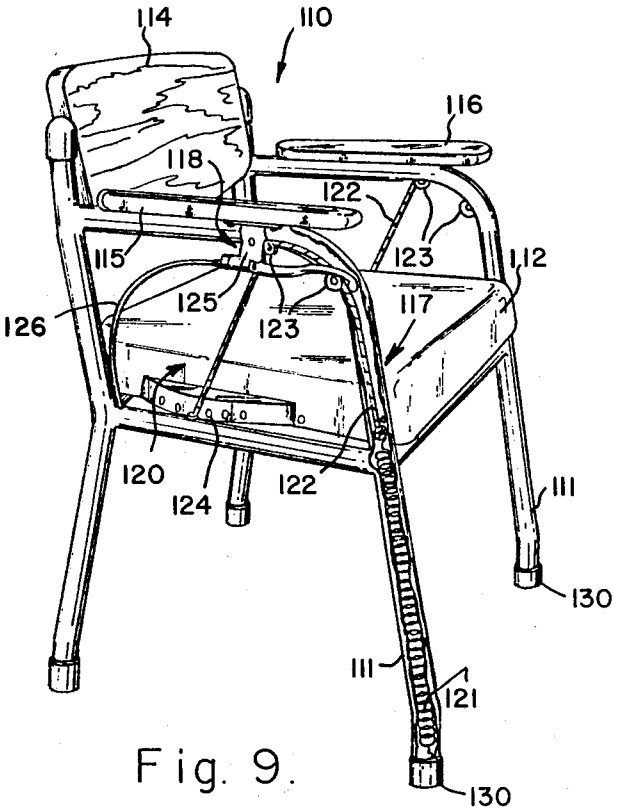
FIG. 9 is a perspective view of a second embodiment of a second orthopedic chair which has been constructed in accordance with the principles of the present invention and which is in a first position having two pairs of pulleys.

Referring to FIG. 9 in conjunction with FIG. 10 a second orthopedic chair 110 includes a frame 111 and a seat 112 which is pivotally coupled to the frame 111 at the front thereof. The second orthopedic chair 110 also includes a back 114, a right arm-rest 115 and a left arm-rest 116 all of which are mechanically coupled to the frame 111.

Figure 12:
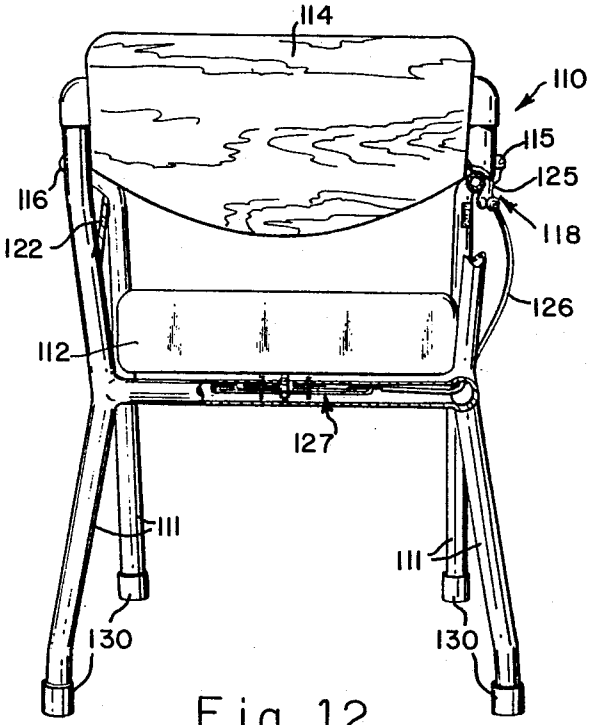
FIG. 12 is a rear elevation of the second orthopedic chair of FIG. 9.
Figure 11:
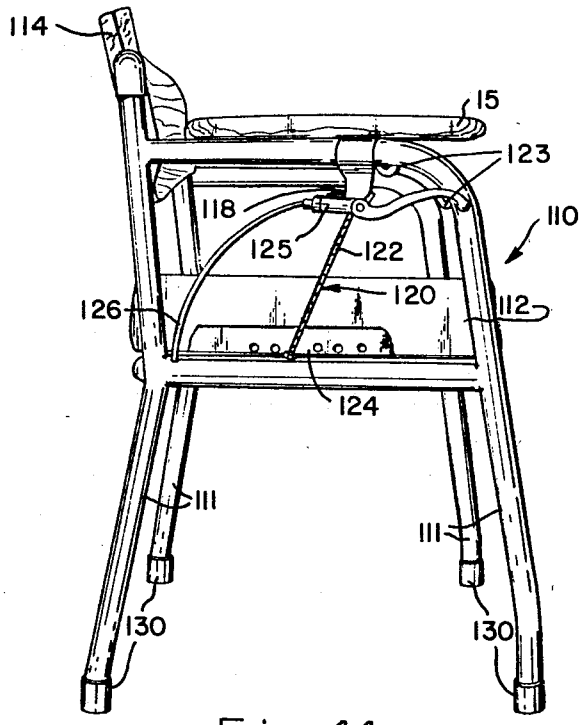
FIG. 11 is a right side elevation of the second orthopedic chair of FIG. 9.

Referring to FIG. 11 in conjunction with FIG. 10 and FIG. 12 the second orthopedic chair 110 further includes a seat mechanism 117 for resiliently pivoting the seat 112 so that it may be used to assist an invalid to easily sit therein or to rise therefrom. The seat mechanism 117 includes a releasing mechanism 118 an a spring tensioning mechanism 120. The spring tensioning mechanism 120 includes a pair of springs 121, a pair of cables 122, two sets of pulleys 123 and a pair of second adjusting devices 124 each of which includes a connector and a connector-mount on which the connector is mounted. Each connector is securely, but detachably coupled to one of the connector-mounts. Each cable 122 has a first end and a second end which is fixedly coupled to one of the connectors. The first end of each cable 122 is fixedly coupled to the second end of one of the springs 121. Each of the springs 121 has a first end which is mechanically coupled to the base of the frame 111. Each cable 122 is threaded through one of the sets of pulleys 123 so that the second end of each cable 122 is securably coupled to the seat 112 by the second adjusting device 124. The spring tensioning mechanism 120 resiliently biases the seat 112, when it is in its first position, toward its second position. The releasing mechanism 118 includes a release lever 125 and a release cable 126 which is mechanically coupled to the release lever 125. The releasing mechanism 118 also includes a releasable latch 127 which is mechanically coupled to the release cable 126.

Referring to FIG. 13 in conjunction with FIG. 9, FIG. 10, FIG. 11 and FIG. 12 each leg of the frame 111 of the second orthopedic chair 110 has an anchorable castor 130 which allows the second orthopedic chair 110 to be rolled about thereon, when no one is sitting in it and which anchor it in place, when someone is sitting in it. The anchorable castor 130 includes a housing 131 and a casing 132 which has a first circular opening at one end and a second circular opening at the other end. The casing 132 is slideably disposed within the housing 131. The anchorable castor 130 also includes a clamping plate 134 and a nut and bolt assembly 135 which secures a spring 136 through the second circular opening to the clamping plate 134 within the casing 132. The anchorable castor 130 further includes a slideable plate 137 and a weight-bearing ball 138. The slideable plate 137 is slideably disposed within the casing 132 and is resiliently coupled to the spring 136. The weight-bearing ball 138 is disposed in the casing 132 adjacent to the slideable plate 137 on its top portion and adjacent to the first circular opening at its bottom portion. The diameter of the weight-bearing ball 138 is larger than the diameter of the first circular opening.

Referring to FIG. 14 in conjunction with FIG. 12 the releasable latch 127 includes a latching mechanism 140 which is disposed within the frame 111 and includes a base plate 141, a latch spring 142, a sliding plate 143, a spacer plate 144 and a cover plate 145. The latch spring 142 resiliently couples the sliding plate 143 to the base plate 141. The spacer plate 144 is mechanically coupled to the base plate 141, but is disposed adjacent to the sliding plate 143. The cover plate 145 is fixedly coupled by a pair of set screws 146 to the base plate 141, the spacer plate 144 to which it is disposed adjacent and the frame 111. A pair of screws fixedly couples the release cable 126 to a spacer bar 148 which is mounted on and mechanically coupled to the sliding plate 143. There is a centrally located circular opening 149 in the frame 111.

Figure 15:
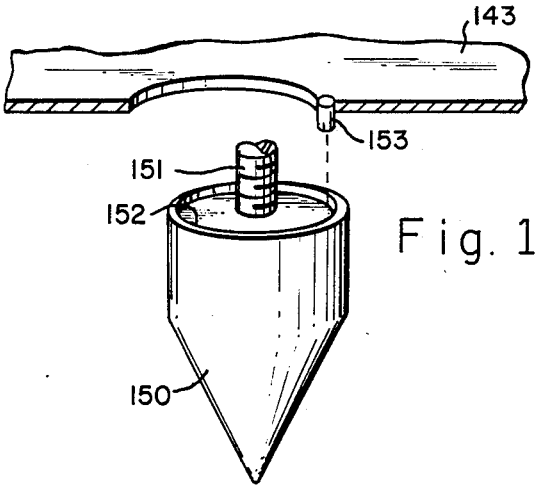
FIG. 15 is a rear elevation in cross-section of the plug and a sliding member of the latch mechanism of FIG. 14 of the second orthopedic chair of FIG. 9 with the sliding member having a pin which engages with the top surface of the plug.

Referring to FIG. 14 in conjunction with FIG. 12 and FIG. 15 the releasable latch 127 also includes a latch plug 150 which has a threaded shank 151, a peripheral lip on its top surface. The threaded shank 151 fixedly couples the latch plug 150 to the seat 112. The sliding plate 143 has a latch pin 153 which engages the peripheral lip 152 of the latch plug 150.

Referring to FIG. 14 in conjunction with FIG. 12, FIG. 15, FIG. 16 and FIG. 17 the sliding plate 143 has a first centrally located bore 143a. The spacer plate 144 has a second centrally located bore 144a. The cover plate 145 has a third centrally located bore 145a. The second and third centrally located bores 144a and 145a are always axially aligned with each other. The first and third centrally located bores 143a and 145a are normally not axially aligned with each other. When a person pulls on the release lever 125 the release cable 126 pulls the sliding plate 143 so that the first and third centrally located bores 143a and 145a become axially aligned. Unless the person sits in the seat 112 the tension generated by the tensioning mechanism 120 exerts an upward force on the latch plug 150 so that the he is unable to pull the release lever 125. When the person sits in the seat 112 his weight exerts a downward force on the latch plug 150 so that the he is able to pull the release lever 125 thereby moving the sliding plate 143 in order to release the latch plug 150 from the latching mechanism 140.

Figure 19:
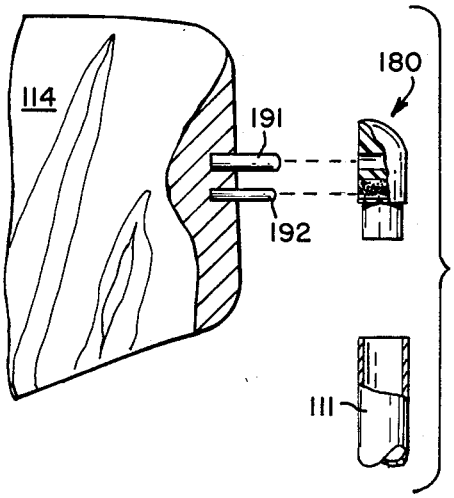
FIG. 19 is a partial front elevation of the back, the left back-mount of FIG. 18 and the frame of the second orthopedic chair of FIG. 9.
Figure 18:
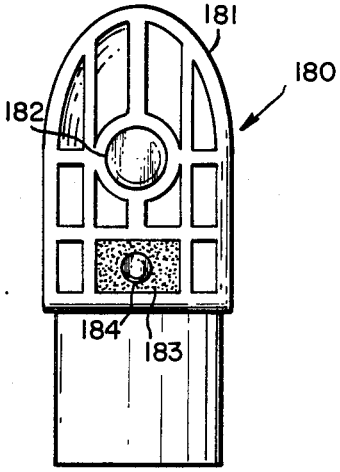
FIG. 18 is a right side elevation of the left back-mount of the second orthopedic chair of FIG. 9.
Figure 20:
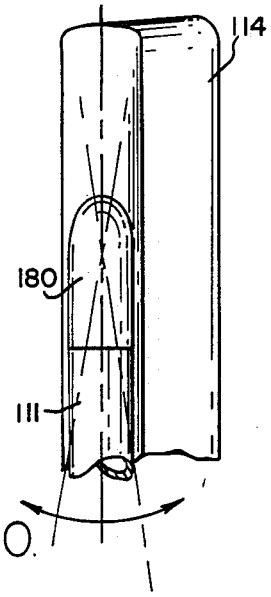
FIG. 20 is a partial left side elevation of the back, the left back-mount of FIG. 18 and the frame of the second orthopedic chair of FIG. 9.

Referring to FIG. 18 in conjunction with FIG. 12, FIG. 19 and FIG. 20 each back-member of the frame 111 of the second orthopedic chair 110 has an a resilient back-mount 180 which is rotatively coupled to the back 114. The resilient back-mount 180 has a housing 181 with a first pivot bore 182 and a block 183 of resilient material disposed in a cavity adjacent to a second pivot bore 184. Each side of the back 114 has a first pin 191 and a second pin 192 which are disposed in and mechanically coupled to the first and second pivot bores 182 and 184.

Figure 21:
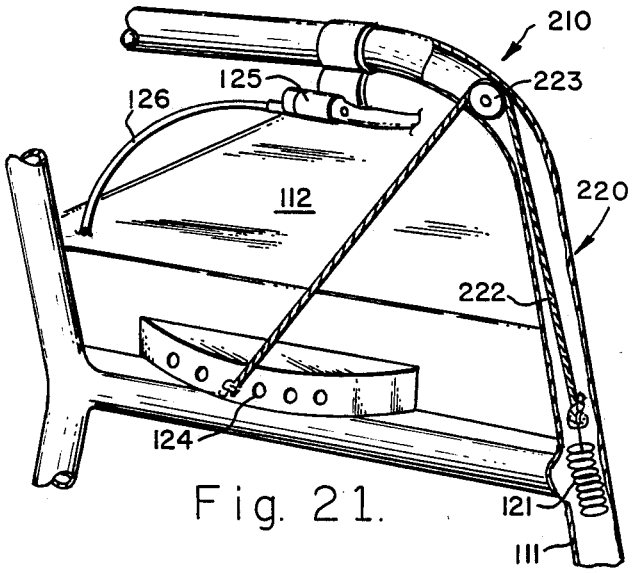
FIG. 21 is a partial perspective view of a third embodiment of a third orthopedic chair which has been constructed in accordance with the principles of the present invention and which is in a first position having two single pulleys.

Referring to FIG. 21 a third orthopedic chair 210 includes a frame 111 and a seat 112 which is pivotally coupled to the frame 111 at the front thereof. The third orthopedic chair 210 also includes a back 114, a right arm-rest 115 and a left arm-rest 116 all of which are mechanically coupled to the frame 111. The third orthopedic chair 210 further includes a seat mechanism 117 for resiliently pivoting the seat 112 so that it may be used to assist an invalid to easily sit therein or to rise therefrom. The seat mechanism 117 includes a releasing mechanism 118 and a spring tensioning mechanism 120. The spring tensioning mechanism 220 includes a pair of springs 121, a pair of cables 122, a pair of single pulleys 223 and a pair of second adjusting devices 124 each of which includes a connector and a connector-mount on which the connector is mounted. Each connector is securely, but detachably coupled to one of the connector-mounts. Each cable 122 has a first end and a second end which is fixedly coupled to one of the connectors. The first end of each cable 122 is fixedly coupled to the second end of one of the springs 121. Each of the springs 121 has a first end which is mechanically coupled to the base of the frame 111. Each cable 122 is threaded through one of the single pulleys 223 so that the second end of each cable 122 is securably coupled to the seat 112 by the second adjusting device 124. The spring tensioning mechanism 120 resiliently biases the seat 112, when it is in its first position, toward its second position. The releasing mechanism 118 includes a release lever 125 and a release cable 126 which is mechanically coupled to the release lever 125. The releasing mechanism 118 also includes a releasable latch 127 which is mechanically coupled to the release cable 126.

The principal advantage of the single pulley/cable system over either the double pulley/cable system or any other springloaded system is that the maximum upward force on the seat 114 is only achieved when the seat 114 is partially raised. This is a result of the placement of each single pulley 223 with respect to one of the second adjusting devices 124. The upward force on the seat 114 decreases as the seat 114 moves in either direction from its partially raised position to both its fully lowered position and its fully raised position. In the downward direction the effective lever arm is being shortened. In the upward direction the spring force is decreasing. Once he activates the release lever 125 the patient needs to initiate the act of standing by moving his body forward before the orthopedic chair 210 will stand him up. The other systems have tendency to catapult him out of the orthopedic chair. Medicare requires the elimination of this tendency.

Referring to FIG. 22 in conjunction with FIG. 21 and FIG. 23 an adjustment tool 300 which is an L-shaped member having a first groove 301 and a second groove 302 may be used to adjust the tension in the spring tensioning mechanism 220. By locking the release cable 126 against the single pulley 223 and then releasing the releasing mechanism 118 one can adjust the second adjusting device 124.

From the foregoing it can be seen that a seat mechanism for resiliently pivoting the seat of an orthopedic chair to assist an invalid to either sit therein or rise therefrom has been described. It should be noted that the sketches are not drawn to scale and that distance of and between the figures are not to be considered significant.

Accordingly it is intended that the foregoing disclosure and showing made in the drawing shall be considered only as an illustration of the principles of the present invention.

What is claimed is:

1. An orthopedic chair comprising:

a. a frame;

b. a seat which is pivotally coupled to said frame at the front thereof;

c. a back which is mechanically coupled to said frame;

d. a pair of arm-rests which are mechanically coupled to said frame;

e. a pair of a springs each of which has a first end which is mechanically coupled to the base of said frame;

f. a pair of cables the first end of each of which is mechanically coupled to a second end of one of said springs;

g. a pair of pulley systems, each of which includes two pulleys which are disposed in series and mechanically coupled to said frame above said seat and through each of which the second end of one of said cables is threaded and wherein the second end of each of said cables is securably coupled to said seat whereby said springs resiliently bias said seat, when it is in its first position, toward its second position so that said seat may be used to assist an invalid to easily sit therein; and h. releasing means for releasing said seat so that said cables moves said seat from its first position to its second position.

2. An orthopedic chair according to claim 1 wherein said releasing means comprises:

a. a release lever which is mechanically coupled to one of said arm-rests;

b. a release cable which is mechanically coupled to said release lever;

c. A pin stop is mechanically coupled to said frame;

d. a latching mechanism including a housing which is mechanically coupled to said seat and a pin which is mechanically coupled to said cable and which is disposed and resiliently biased within said housing, said pin engaging said pin stop whereby the movement of said pin causes said pin to move away and disengage from said pin stop in order for said springs to move said seat from its first position to its second position; and e. restraining means for restraining the movement of said pin so that said pin can not move away from said pin stop unless a person is sitting in said orthopedic chair.

3. An orthopedic chair comprising a. a frame;

b. a seat which is pivotally coupled to said frame at the front thereof;

c. a back which is mechanically coupled to said frame;

d. a pair of arm-rests which are mechanically coupled to said frame;

e. a pair of springs each of which has a first end which is mechanically coupled to the base of said frame;

f. a pair of cables the first end of each of which is mechanically coupled to a second end of one of said springs;

g. a pair of pulleys which are mechanically coupled to said frame above said seat and through each of which the second end of one of said cables is threaded and wherein said second end of each of said cables is securably coupled to said seat whereby said springs resiliently bias said seat, when it is in its first position, toward its second position so that said seat may be used to assist an invalid to easily sit therein; and h. releasing means for releasing sais seat so that said cables moves said seat from its first position to its second position.

4. An orthopedic chair according to claim 3 wherein said releasing means comprises:

a. a release lever which is mechanically coupled to one of said arm-rests;

b. a release cable which is mechanically coupled to said release lever;

c. a pin stop is mechanically coupled to said frame;

d. a latching mechanism including a housing which is mechanically coupled to said seat and a pin which is mechanically coupled to said cable and which is disposed and resiliently biased within said housing, said pin engaging said pin stop whereby the movement of said pin causes said pin to move away and disengage from said pin stop in order for said springs to move said seat from its first position to its second position; and e. restraining means for restraining the movement of said pin so that said pin can not move away from said pin stop unless person is sitting in said orthopedic chair.

5. An orthopedic chair according to claim 3 wherein a pair of adjusting devices each of which comprises:

a. a connector which is fixedly coupled to a second end of each cable; and b. a connector-mount to which each of said connectors is securely, but detachably coupled whereby an adjustment tool, which is an L-shaped member having a first groove and a second groove, may be used to adjust the tension in said springs by means of locking said cable against said pulley and then releasing said releasing means so that one can adjust said adjusting device.

6. An orthopedic chair according to claim 3 wherein said releasing means comprises:

a. a release lever which is mechanically coupled to one of said arm-rests;

b. a release cable which is mechanically coupled to said release lever;

c. a latch plug which has a threaded shank which fixedly couples said latch plug to said seat and which also has a peripheral lip on its top surfaces.

d. a base plate which is mechanically coupled to said seat of said frame;

e. a sliding plate which as a first centrally located bore and which has a latch pin which engages said peripheral lip of said latch plug;

f. a spacer plate which is mechanical coupled to said base plate, but is disposed adjacent to said sliding plate and which has a second centrally located bore which is normally not axially aligned with said first centrally located bore;

g. a cover plate which is fixedly coupled by a pair of set screws to said base plate and which has a third centrally located bore which is always aligned with said second centrally located bore; and h. a latch spring which resiliently couples said sliding plate to said base plate whereby when a person pulls on said release lever said release cable pulls said sliding plate so that said first and third centrally located bores and become axially aligned.

7. An orthopedic chair according to claim 1 or 3 wherein said seat has a center hole so that an invalid may use said the orthopedic chair in conjunction with a toilet and wherein said orthopedic chair also comprises a cover-plate which covers said center hole of said seat so that the invalid may use said orthopedic chair for other activities.

8. An orthopedic chair according to claim 1 wherein said releasing means comprises:

a. a release lever which is mechanically coupled to one of said arm-rests;

b. A release cable which is mechanically coupled to said release lever;

c. a latch plug which has a threaded shank which fixedly couples said latch plug to said seat and which also has a peripheral lip on its top surface.

d. A base plate which is mechanically coupled to said seat of said frame;

e. a sliding plate which has a first centrally located bore and which as a latch pin which engages said peripheral lip of said latch plug;

f. a spacer plate which is mechanically coupled to said base plate, but is disposed adjacent to said sliding plate and which has a second centrally located bore which is normally not axially aligned with said first centrally located bore;

g. a cover plate which is fixedly coupled by a pair of set screws to said base plate and which has a third centrally located bore which is always aligned with said second centrally located bore; and h. a latch spring which resiliently couples said sliding plate to said base plate whereby when a person pulls on said release lever said release cable pulls said sliding plate so that said first and third centrally located bores and becomes axially aligned.

* * * * *